US009622569B2

(12) United States Patent
Browne

(10) Patent No.: US 9,622,569 B2
(45) Date of Patent: Apr. 18, 2017

(54) COMPACT-STAND, FOLDING TABLE

(71) Applicant: Bill Browne, Atlanta, GA (US)

(72) Inventor: Bill Browne, Atlanta, GA (US)

(73) Assignee: Atleisure LLC, Atlanta, GA (US)

( * ) Notice: Subject to any disclaimer, the term of this patent is extended or adjusted under 35 U.S.C. 154(b) by 0 days.

(21) Appl. No.: 14/971,067

(22) Filed: Dec. 16, 2015

(65) Prior Publication Data

US 2017/0013954 A1 Jan. 19, 2017

Related U.S. Application Data

(60) Provisional application No. 62/191,552, filed on Jul. 13, 2015.

(51) Int. Cl.
*A47B 3/02* (2006.01)
*A47B 3/00* (2006.01)

(52) U.S. Cl.
CPC ..... *A47B 3/02* (2013.01); *A47B 3/002* (2013.01)

(58) Field of Classification Search
CPC .... A47B 3/02; A47B 3/08; A47B 3/14; A47B 2003/025; A47B 2003/145
USPC ..... 108/115, 118
See application file for complete search history.

(56) References Cited

U.S. PATENT DOCUMENTS 413,324 A * 10/1889 Ketchum ..... A47B 3/02 108/118
1,487,144 A * 3/1924 Callaway ..... D06F 81/02 108/118
1,942,603 A * 1/1934 Johanson ..... A47B 3/02 108/119
1,990,032 A * 2/1935 Johanson ..... A47B 3/02 108/119
D149,619 S * 5/1948 Dahm ..... 108/118
2,601,357 A * 6/1952 Sampson ..... A47B 3/02 108/118
3,062,603 A * 11/1962 Kamenstein ..... A47B 3/02 108/116
3,646,895 A * 3/1972 Campbell ..... A47B 3/02 108/118
5,335,604 A * 8/1994 Jiang ..... A47B 3/02 100/119
5,829,365 A * 11/1998 Cheng ..... A47B 3/02 108/118
6,536,359 B2 * 3/2003 Liu ..... A47B 3/02 108/118
7,685,750 B2 * 3/2010 Voitchovsky ..... D06F 81/02 108/122

(Continued)

*Primary Examiner* — Janet M Wilkens
(74) *Attorney, Agent, or Firm* — ATLawip LLC; Jeffrey T. Brelaski

(57) ABSTRACT

A folding table is disclosed which has a table top and a leg assembly. The leg assembly includes a pair of unitary legs and a pair of collapsible legs. Each unitary leg has a top end and a bottom end. Each collapsible leg includes a lower leg portion and an upper leg portion pivotally coupled at its lower end through a second pivot. The lower leg portion has top end with a locking flange which extends outwardly so as to abut the upper leg portion when the collapsible leg is in a fully extended position. The lower leg portion has a bottom end. The bottom ends of both the unitary legs and the collapsible legs contact the support surface while the folding table is in both its extended and collapsed configurations.

13 Claims, 2 Drawing Sheets

(56) References Cited

U.S. PATENT DOCUMENTS

| | | | | |
|---|---|---|---|---|
| 2005/0120922 | A1* | 6/2005 | Brooks | A47B 3/02 108/118 |
| 2007/0221104 | A1* | 9/2007 | Tseng | A47B 3/02 108/118 |

* cited by examiner

COMPACT-STAND, FOLDING TABLE

CROSS-REFERENCE TO RELATED APPLICATION

This application claims the benefit of U.S. Provisional Application No. 62/191,552, filed Jul. 13, 2015.

FIELD OF THE INVENTION

This invention relates generally to tables, and specifically to folding tables.

BACKGROUND OF THE INVENTION

Tables have existed for centuries. A table typically includes a table top and an arrangement of legs to support the table top.

In an effort to minimize the space occupied by a table when not in use, some tables have been designed with folding legs so that they may be easily stowed in a compact configuration. The legs are folded to a retracted position closely adjacent the table top wherein the table may then be stowed. However, a problem with such a design is that the table is typically stored on its side as it is no longer supported on its legs. Such storing may cause damage to the side of the table which contacts the flooring, or may create a problem regarding the available areas capable of storing the table while lying upon its side.

Another problem associated with folding tables is that they may include mounting bolts that must be removed in order to fold the legs. The existence of mounting bolts creates its own problems regarding the storage of the loose bolts or their loss thereby rendering the table inoperable.

Accordingly, it is seen that a need remains for a folding table that can quickly and easily be folded and unfolded, as well as a table that can be easily stowed in most any area without causing damage to the table. It is to the provision of such therefore that the present invention is primarily directed.

BRIEF SUMMARY OF THE INVENTION

A folding table capable of being moved between an extended configuration and a collapsed configuration comprises a table top, and a leg assembly coupled to the table top. The leg assembly has a pair of first legs pivotally coupled to the table top along a top end of the first legs, and a pair of second legs pivotally coupled to the table top along a top end of the second legs. Each first leg of the pair of first legs is pivotally coupled to a second leg of the pair of second legs for pivotal movement about a first pivot. Each second leg of the pair of second legs has an upper leg portion and a lower leg portion pivotally coupled to the upper leg portion for pivotal movement about a second pivot. The second pivot is located along the second leg at a location between the first pivot and the top end of the second leg. The leg assembly also has a stop releasably coupling the upper leg portions and the lower leg portions together in an extended position.

This and other aspects of the present invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
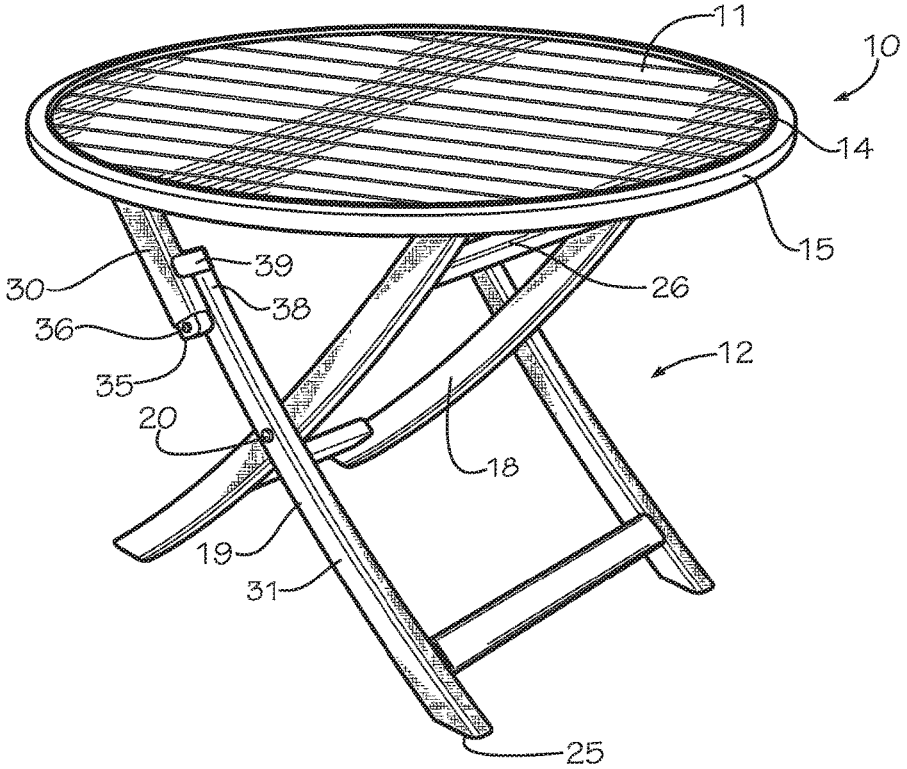
FIG. 1 is a perspective view of a folding table embodying principles of the invention in a preferred form.

The present disclosure will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

With reference next to the drawings, there is shown a folding table 10 in a preferred form of the invention. The folding table 10 includes a table top 11 and a leg assembly 12. The folding table is capable of being reconfigured between an extended configuration and a collapsed configuration.

The table top 11 is shown in the form of a round table top having a top surface 14 and an oppositely disposed bottom surface 15. However, it should be understood that the table top may be in any shape and is not restricted to the round shape shown in the preferred embodiment. The table top 11 may be made of any conventional material, including but not limited to wood, metal, plastic, composite material, or the like.

The leg assembly 12 includes a pair of unitary legs 18 and a pair of collapsible legs 19 pivotally coupled to the unitary legs 18 through a first pivot or pivot pin 20. The components of the leg assembly 12 may be made of any conventional material, including but not limited to wood, metal, plastic, composite material, or the like.

Each unitary leg 18 has a top end 23 pivotally coupled to the bottom surface 15 of the table top 11 through a first top hinge 24 and a bottom end or foot 25 which may be angled to conform to a support surface such as a floor. The unitary legs 18 are joined to each other through a top horizontal transversing element, member or cross-bar 26 and a bottom horizontal transversing element, member or cross-bar 27. The first top hinges 24 allow the unitary legs 18 to be pivoted between an extended position or configuration distal the table top 11, shown in FIGS. 1 and 2, and a folded or retracted position or configuration closely adjacent the table top 11, shown in FIGS. 3 and 4.

Each collapsible leg 19 includes an upper leg element or portion 30 and a lower leg element or portion 31. The upper leg portion 30 is pivotally coupled at its top end 33 to the bottom surface 15 of the table top 11 through a second top hinge 34. The upper leg portion 30 is also pivotally coupled at its lower end 35 to the associated lower leg portion 31 through a second pivot or pivot pin 36. The second pivot pin 36 extends through the lower end 35 of the upper leg portion 30 and through the lower leg portion 31 at a location spaced from or away from the top end 38 of the lower leg portion 31. The lower leg portion 31 has top end 38 with a stop or lock in the form of a locking flange or plate 39 which extends outwardly from the lower leg portion 31 so as to abut or contact the upper leg portion 30 when the collapsible leg is in a fully extended position, i.e., the lower leg portion 31 and the upper leg portion 30 are releasably fixed or locked together through the engagement of the locking plate 39 against the upper leg portion 30. The lower leg portion 31 has a bottom end or foot 41 which may be angled to conform to an underlying support surface or floor. The collapsible legs 19 are joined to each other through a bottom horizontal transversing element, member or cross-bar 43.

Figure 2:
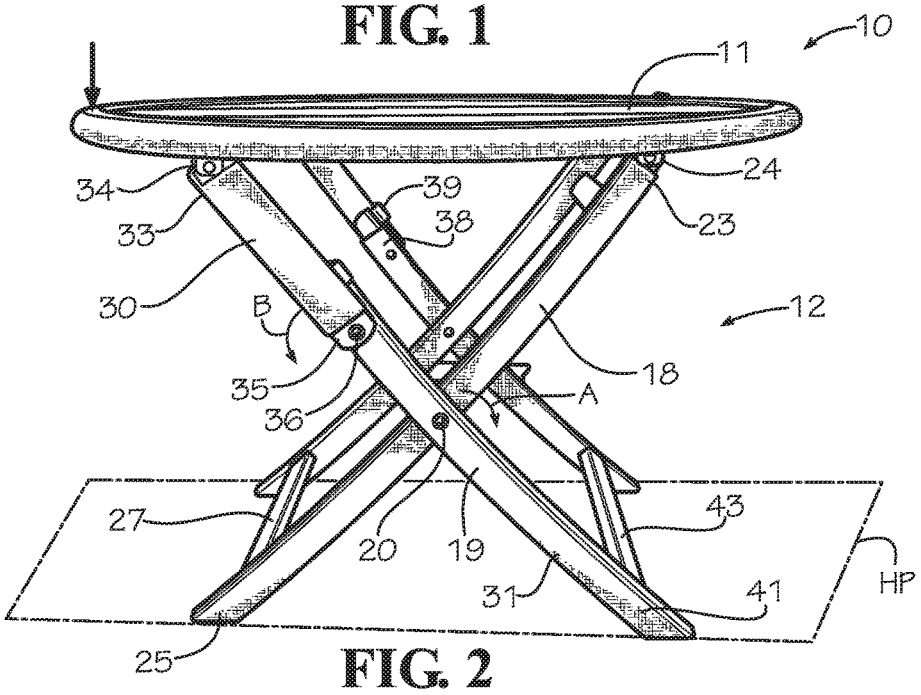
FIG. 2 is a perspective, side view of the folding table of FIG. 1, shown in an extended configuration.
Figure 4:
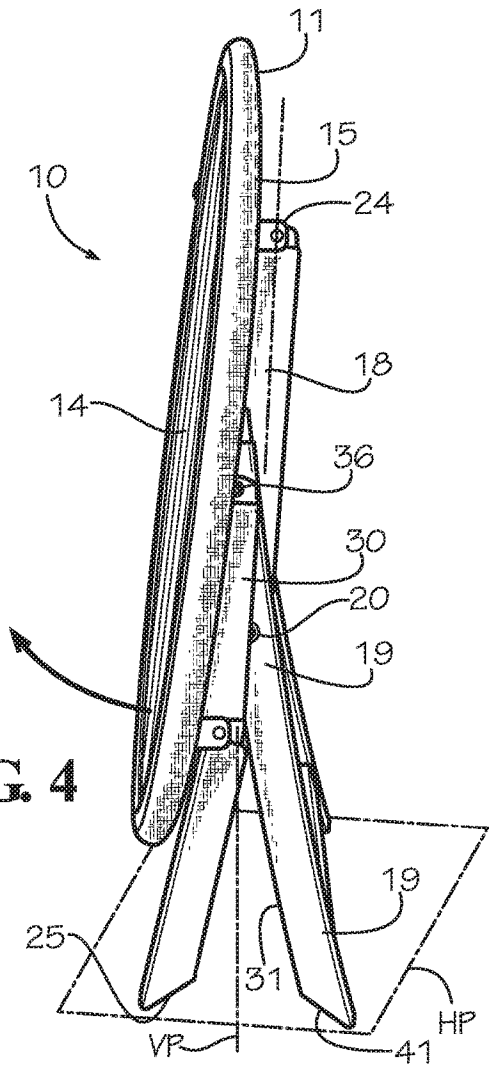
FIG. 4 is side view of the folding table of FIG. 1, shown in a folded configuration.
Figure 3:
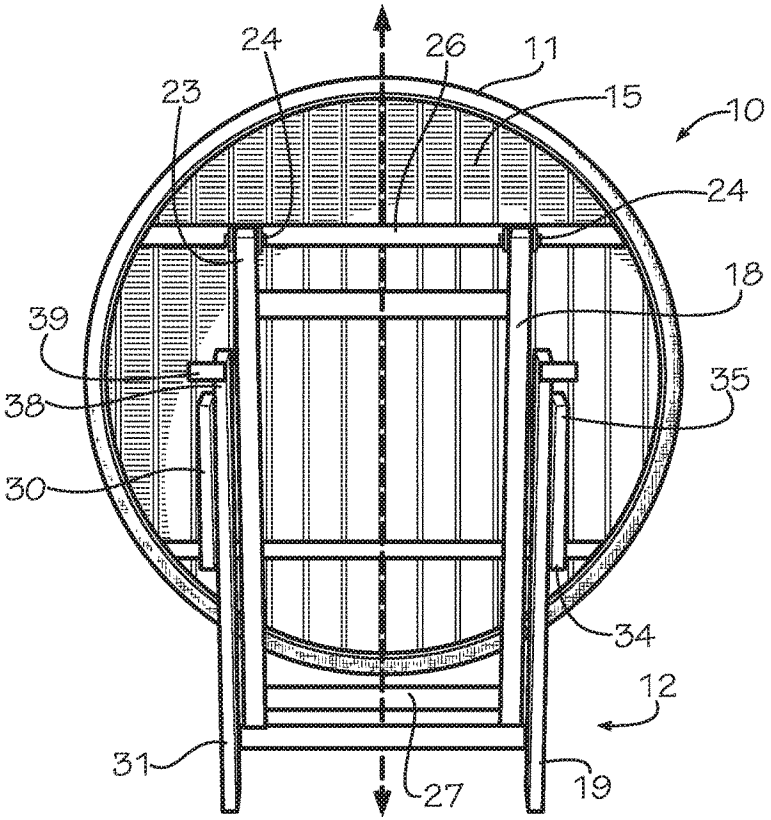
FIG. 3 is a perspective, rear view of the folding table of FIG. 1, shown in a folded or collapsed configuration.

The second top hinges 34 allow the upper leg portions 30 of the collapsible legs 19 to be pivoted between an extended position distal the table top 11, shown in FIGS. 1 and 2, and a retracted position closely adjacent the table top 11, shown in FIGS. 3 and 4.

It is preferred that the unitary and collapsible legs be outwardly curved away from the table top as this is believed to place an outward force upon the locking flange 39 which aids in preventing the collapsible legs from accidentally folding or collapsing during use.

In use, the folding table 10 may be utilized in an upright, extended configuration, shown in FIGS. 1 and 2, in the usual fashion. Here, the unitary legs 18 and collapsible legs 19 are fully extended with the upper and lower leg portions 30 and 31 of the collapsible legs 19 releasably locked together through the abutment of the lower portion's locking flange 39 against the upper leg portion 30. It should be noted that the feet 25 and 41 of all four legs are located generally upon the same horizontal plane HP (support surface) to provide for a stable, upright table.

The folding table 10 may be moved from its extended configuration to its retracted configuration, shown in FIGS. 3 and 4, by lifting upon the table top 11 in the area about the first top hinge 24. This motion alone or with the assistance of an inward push upon the top end 38 of the lower leg portion 31 of the collapsible leg 19 causes the lower leg portion 31 to pivot about first pivot pin 20, as indicated by arrow A, thereby simultaneously causing the upper leg portion 30 to pivot relative to the lower leg portion 31 about second pivot pin 36, as indicated by arrow B. This motion continues until the table reaches its fully retracted position with the unitary legs 18 and both the upper and lower leg portions 30 and 31 of the collapsible legs 19 folded closely adjacent the bottom surface 15 of the table top 11, as shown in FIGS. 3 and 4.

It should be noted that the position of the second pivot pin 36 along the length of the lower leg portion 31 is calculated so that once the collapsible leg is folded to its retracted position the feet 25 and 41 of both the unitary and collapsible legs, or at least a portion of each foot, are again located along a common horizontal plane HP (support surface). This positioning of the legs 18 and 19, and specifically their feet 25 and 41, ensures that the table 10 may be stowed upright in its collapsed configuration upon all four legs/feet to maintain a stable, upright position. This positioning also enables the folding table to be stowed without having to place the folding table upon its side or against a wall and thereby avoids damaging damage or marring of the table top side.

It should also be understood that the present invention allows all the upper and lower leg portion of the collapsible legs and the unitary legs of the leg assembly to essentially lie in the same general vertical plane VP, the term essentially being used as the curvature of the legs dictate that they cannot truly lie in the same plane and therefore a general mutual alignment is meant by the term. This mutual planer alignment of the legs in their stowed configuration produces a minimum table depth when stowed. The vertical plane should be understood to exist generally parallel to and spaced from the plane including the bottom surface 15 of the table top.

It should be understood that the first and second pivot pins provide fixed pivots, as opposed to moving or sliding pivots associated with brackets having a pivot pin which resides within an elongated slot through which the pivot pin may slide.

It should be understood that as an alternative to the locking flange 39, other types of stops or locking devices may be utilized, such as detents, latches, locking pins, brackets, or the like. Lastly, it should be understood that the relative positioning of the flange upon the upper and lower leg portions may be reversed, i.e., the flange may be mounted to the upper leg portion for abutment with the top end of the lower leg portion.

It thus is seen that a folding table is now provided which enables the folding table to be quickly and easily placed in a vertical, stowed configuration while enabling the table to be stably stowed upon the feet of its four legs. While this invention has been described in detail with particular references to the preferred embodiments thereof, it should be understood that many modifications, additions and deletions, in addition to those expressly recited, may be made thereto without departure from the spirit and scope of the invention.

The foregoing description of the exemplary embodiment of the invention has been presented only for the purposes of illustration and description and is not intended to be exhaustive or to limit the invention to the precise forms disclosed. Many modifications and variations are possible in light of the above teaching.

The embodiment was chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A folding table capable of being moved between an extended configuration and a collapsed configuration, said folding table comprising, a table top, and a leg assembly coupled to said table top, said leg assembly having a pair of first legs pivotally coupled to said table top along a top end of said first legs, and a pair of second legs pivotally coupled to said table top along a top end of said second legs, each first leg of said pair of first legs being pivotally coupled to a second leg of said pair of second legs for pivotal movement about a first pivot, each said second leg of said pair of second legs having an upper leg portion and a lower leg portion pivotally coupled to said upper leg portion for pivotal movement about a second pivot, said second pivot being located along said second legs at a location between said first pivot and said top end of said second legs, and a stop releasably holding said upper leg portions and said lower leg portions together in an extended position, wherein when said folding table is in said extended configuration, each of said first legs and said second legs is outwardly curved continuously between the top end of said legs to the lower end of said legs, as a whole, away from said table top.

2. The folding table of claim 1 wherein said second pivot is positioned at a location along said second legs to allow said upper leg portion, said lower leg portion and said first legs to reside generally along a common plane adjacent said table top when said folding table is in a collapsed configuration.

3. The folding table of claim 1 wherein said stop comprises a flange extending from either said upper leg portion or said lower leg portion for engagement with the other coupled either said upper leg portion or lower leg portion.

4. The folding table of claim 1 wherein each said lower leg portion has a top end, and wherein said stop comprises a flange extending from each said top end of said lower leg portions for engagement with said upper leg portions.

5. The folding table of claim 1 wherein said pair of first legs have lower ends configured to engage a supporting surface, wherein said pair of second legs have lower ends configured to engage a supporting surface, and wherein said lower ends of said first pair of legs and said lower ends of said second pair of legs are generally aligned upon a common plane when said folding table is in both its extended configuration and its collapsed configuration.

6. A folding table capable of being moved between an extended configuration and a collapsed configuration, said folding table comprising, a table top;

a pair of unitary legs pivotally coupled to said table top;

a pair of collapsible legs pivotally coupled to said table top and pivotally coupled to said unitary legs, each said collapsible leg including an upper leg portion having a first end pivotally coupled to said table top and a second end pivotally coupled to a lower leg portion of said collapsible leg, and a stop releasably locking said upper leg portions to said lower leg portions when said collapsible legs are in a table extended configuration, wherein when said folding table is in said extended configuration, each of said unitary legs and said collapsible legs is outwardly curved continuously between the top end of said legs to the lower end of said legs, as a whole, away from said table top.

7. The folding table of claim 6 wherein said upper leg portion, said lower leg portion, and said unitary legs all reside generally along a common plane when said folding table is in a collapsed configuration.

8. The folding table of claim 6 wherein said stop comprises a flange extending from either said upper leg portion or said lower leg portion for engagement with the other coupled either said upper leg portion or lower leg portion.

9. The folding table of claim 6 wherein said stop comprises a flange extending from each said first end of said lower leg portions for engagement with said upper leg portions.

10. The folding table of claim 6 wherein said pair of unitary legs have lower ends configured to engage a supporting surface, wherein said pair of collapsible legs have lower ends configured to engage a supporting surface, and wherein lower ends of said unitary legs and said lower ends of said collapsible legs are generally aligned upon a common plane when said folding table is in both its extended configuration and its collapsed configuration.

11. A folding table capable of being moved between an extended configuration and a collapsed configuration upon a table support surface, said folding table comprising, a table top;

a pair of first legs, each first leg of said pair of first legs having an top end pivotally coupled to said table top and a lower end opposite said top end of said first leg, and a pair of second legs pivotally coupled to said pair of first legs, each second leg of said pair of second legs having a top end pivotally coupled to said table top and a lower end opposite said top end of said second leg;

wherein said pair of first legs and said pair of second legs are configured so that said lower ends of said pair of first legs and said lower ends of said pair of second legs each contact the table support surface simultaneously to support said folding table upright when said folding table is in an extended configuration, and so that said lower ends of said pair of first legs and said lower ends of said pair of second legs each contact the table support surface simultaneously to support said folding table upright when said folding table is in a collapsed configuration, and wherein when said folding table is in said extended configuration, each of said first legs and said second legs is outwardly curved continuously between the top end of said legs to the lower end of said legs, as a whole, away from said table top.

12. The folding table of claim 11 wherein each said second leg of said pair of second legs has an upper leg portion and a lower leg portion pivotally coupled to said upper leg portion for pivotal movement about a pivot, said pivot being located along said lower leg portions of said second legs at a location between said first pivot and said top end of said second legs, and wherein said folding table further comprises a stop releasably coupling said upper leg portions and said lower leg portions together in an extended position.

13. The folding table of claim 12 wherein said pivot is positioned at a location along said second legs to allow said upper leg portion, said lower leg portion and said first legs to reside generally along a common plane adjacent said table top when said folding table is in a collapsed configuration.

* * * * *